US009204733B2

(12) United States Patent
Welch et al.

(10) Patent No.: US 9,204,733 B2
(45) Date of Patent: Dec. 8, 2015

(54) CHILD'S WALKING AND JUMPING DEVICE

(71) Applicant: Mattel, Inc., El Segundo, CA (US)

(72) Inventors: Juliette Marlene Welch, East Aurora, NY (US); Robert M. Goszewski, Depew, NY (US); Chalin Yu, Williamsville, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 14/203,946

(22) Filed: Mar. 11, 2014

(65) Prior Publication Data

US 2014/0265457 A1 Sep. 18, 2014

Related U.S. Application Data

(60) Provisional application No. 61/782,773, filed on Mar. 14, 2013.

(51) Int. Cl.
*A47D 13/10* (2006.01)
*A47D 13/04* (2006.01)

(52) U.S. Cl.
CPC ..... *A47D 13/043* (2013.01); *A47D 13/107* (2013.01)

(58) Field of Classification Search
USPC ..... 297/5, 6, 274, 258.1–272.4, 440.24; 472/118, 135
See application file for complete search history.

(56) References Cited

U.S. PATENT DOCUMENTS

| | | | | |
|---|---|---|---|---|
| 16,942 A | | 3/1857 | Wellman | |
| 150,398 A | * | 5/1874 | Clonen et al. | 482/51 |
| 761,514 A | * | 5/1904 | Leininger | 482/51 |
| 839,681 A | * | 12/1906 | Voigt, Sr. | 297/138 |
| 875,377 A | * | 12/1907 | Pilia et al. | 482/51 |
| 1,154,543 A | * | 9/1915 | Passerieux | 482/51 |
| 1,294,300 A | | 2/1919 | Noel | |
| 1,419,890 A | | 6/1922 | Noel | |
| 1,642,184 A | | 9/1927 | Urso | |
| 2,766,464 A | * | 10/1956 | Savi | 5/93.1 |
| 3,204,954 A | | 9/1965 | Scannell | |
| 4,162,101 A | * | 7/1979 | McCague et al. | 297/6 |
| 4,844,452 A | | 7/1989 | Tomosky | |

(Continued)

FOREIGN PATENT DOCUMENTS

| | | |
|---|---|---|
| EP | 0549544 A1 | 6/1993 |
| GB | 2433703 A | 12/2005 |
| WO | 0124884 A1 | 4/2001 |

OTHER PUBLICATIONS

Combined Search and Examination Report Under Sections 17 and 18(3) from the Intellectual Property Office of Great Britain, dated Aug. 21, 2014, for British Application No. GB1404243.6.

*Primary Examiner* — Rodney B White
(74) *Attorney, Agent, or Firm* — Edell, Shapiro & Finnan, LLC

(57) ABSTRACT

An infant support structure includes a frame, at least one sliding or translating member movably coupled to the frame, a seat support, and at least one resilient member coupling the seat support and at least one translating member together. The frame contains at least two substantially parallel members that are reconfigurable in a compact configuration and an extended configuration. When the frame is configured in the extended configuration, the translating members are able to move from one end of the frame to the other, simulating an infant walker. The resilient members coupling the sliding members and seat support together enable the infant support structure to serve as an infant jumper/bouncer.

20 Claims, 8 Drawing Sheets

(56) References Cited

U.S. PATENT DOCUMENTS

| | | | | |
|---|---|---|---|---|
| 4,948,120 | A | 8/1990 | Krueger et al. | |
| 5,522,782 | A | 6/1996 | Kurtin | |
| 5,690,383 | A | 11/1997 | Meeker | |
| 5,704,882 | A | 1/1998 | Coates et al. | |
| 5,857,944 | A | 1/1999 | Cone et al. | |
| 5,876,311 | A | 3/1999 | Coates et al. | |
| 6,001,047 | A | 12/1999 | Ferrara | |
| 6,932,709 | B1 | 8/2005 | Gubitosi et al. | |
| 7,244,165 | B2 * | 7/2007 | Gubitosi et al. | 446/175 |
| 7,614,979 | B2 | 11/2009 | Thomson et al. | |
| 7,713,175 | B2 | 5/2010 | Monaghan | |
| 8,690,245 | B2 * | 4/2014 | Tuckey | 297/274 |
| 2008/0012409 | A1 | 1/2008 | Chen et al. | |
| 2009/0062082 | A1 | 3/2009 | Spencer-Kramer | |
| 2010/0062682 | A1 | 3/2010 | Bering | |
| 2010/0221974 | A1 | 9/2010 | Monaghan | |
| 2011/0104979 | A1 | 5/2011 | Monaghan | |
| 2012/0100972 | A1 | 4/2012 | Prohaska et al. | |

* cited by examiner

CHILD'S WALKING AND JUMPING DEVICE

CROSS-REFERENCE TO RELATED APPLICATION

This application claims priority to and is based on U.S. Patent Application No. 61/782,773, filed Mar. 14, 2013, entitled "Child's Walking and Jumping Device," the entire disclosure of which is incorporated herein by reference in its entirety.

FIELD OF THE INVENTION

The present invention relates to a device that supports a child when the child performs walking and jumping motions. More specifically, the present invention is a device that can function both as an infant jumper and an infant walker.

BACKGROUND OF THE INVENTION

Various types of infant support structures exist for infants and children to promote the development of large motor skills, such as walking and jumping. Parents of infants are required to purchase multiple infant support structures for their children, including, but not limited to, infant walkers, infant jumpers, infant seats, infant swings, and infant gliders. Each one of these infant support structures requires space for use and storage. Parents who own multiple infant support structures often find themselves looking for more space to store the products that they purchase for their infants. Furthermore, each one of these infant support structures is relatively expensive, and the purchase of multiple infant support structures can be costly. Moreover, each one of these infant support structures only serves a single function. For example, an infant walker only teaches an infant to walk, while infant jumpers develop an infant's ability to jump and use its legs. This requires the removal of the infant from one infant support structure to another when either the infant or the parent wants the infant in a different infant support structure to perform a different activity.

Therefore, what is needed is an infant support structure that performs multiple functions and serves more than one purpose for the development of an infant's motor skills. Furthermore, what is needed is an infant support structure that is easy for the parents to set up and maintain. In addition, the infant support structure should be fun and easy for the infant to use. Moreover, what is needed is an infant support structure that is safe for the infant to use.

SUMMARY OF THE INVENTION

According to one exemplary embodiment, the present invention includes an infant support structure having a frame with at least two substantially parallel members, at least one sliding or translating member movably disposed on the frame, a seat support, and at least one resilient member coupling the seat support to the sliding or translating member. The at least two substantially parallel members are configured to be expandable between two configurations, a compact configuration and an extended configuration. Furthermore, the at least one sliding or translating member is configured to slide along the at least two substantially parallel members.

BRIEF DESCRIPTION OF THE DRAWINGS

Like reference numerals have been used to identify like elements throughout this disclosure.

DETAILED DESCRIPTION OF THE INVENTION

Figure 1:
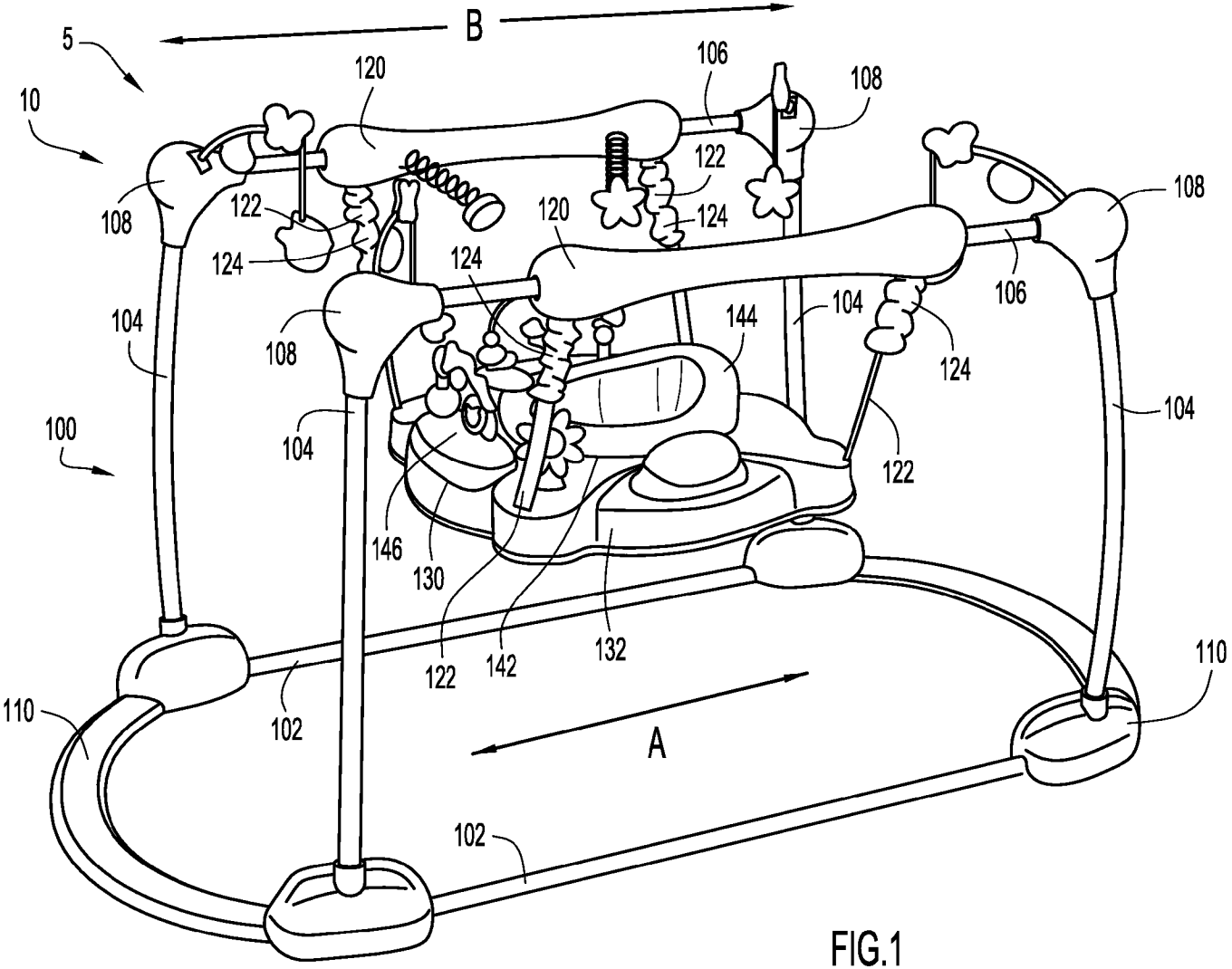
FIG. 1 illustrates a perspective view of a first embodiment of an infant support structure according to the present invention.

Referring to FIG. 1, illustrated is a first embodiment 10 of the infant support structure 5. The first embodiment 10 includes a frame 100. As illustrated, the frame 100 includes two parallel floor members 102, two parallel upper members 106, and four vertical members 104. The four vertical members 104 are connected to the two parallel floor members 102 via lower connection ends 110. In this embodiment, the vertical members 104 connect to the lower connection ends 110 through the top of the lower connection ends 110. Furthermore, in this embodiment, lower parallel members 102 connect to the lower connection ends 110 through the sides of the lower connection ends 110. In addition, the lower connection ends 110 include outwardly extending arcuate portions that provide additional stability support for the frame 100.

Continuing with the frame 100 of the first embodiment 10, the vertical members 104 are connected to the two parallel upper members 106 via four elbow connections 108. The frame 100, and specifically the two parallel upper members 106 and two parallel floor members 102, are expandable along expansion direction A. In this embodiment, the upper members 106 and the floor members 102 may be expandable via a telescoping connection. In other embodiments other similar mechanisms may be used.

Additionally illustrated in FIG. 1 are sliding or translating members 120. In this embodiment, the sliding or translating members 120 are configured to be wrapped around the upper members 106. The sliding or translating members 120 are configured to slide along direction B and the upper members 106 when the frame 100 is in the expanded position (as shown). The sliding or translating members 120 may include internal bearings to enable the sliding or translating members 120 to slide along the upper members 106. In other embodiments, other similar mechanisms may be used to allow the sliding or translating members 120 to slide along the upper members 106, including the sliding or translating members 120 and the upper members 106 being constructed from materials that produce a low amount of rolling/sliding frictional resistance.

According to the embodiment illustrated in FIG. 1, each sliding or translating member 120 includes two resilient members 122. These resilient members 122 connect each of the sliding or translating members 120 to a suspended seat support 130. The resilient members 122 are constructed from a spring, elastic band, or other similarly resilient material that will enable the seat support 130 to move up and down with respect to the frame 100 and sliding or translating members 120. The resilient members 122 support the seat support 130 above the support surface at a designated height. Furthermore, the resilient members 122 include coverings 124 that wrap around the resilient members 122. The coverings 124 prevent the child from sticking their fingers, toys, and other items in the resilient members 122.

Once a child is placed in the seat support 130, the resilient members 122 allow for the jumping feature of the infant support structure 5, enabling the infant support structure 5 to be used as an infant jumper. The resilient members 122 enable the seat support 130 to move upwards and downwards from the designated height. Once an infant jumps upwards, and is coming back down past the designated height, the resilient members 122 provide resistance preventing the seat support 130 from moving downwardly too far and too fast. Furthermore, the resilient members 122 enable the seat support 130 to spring back to its designated height.

In addition, when the frame 100, upper members 106, and lower members 102 are in the expanded position and the child is placed in the seat support 130, the infant support structure 5 can be used as an infant walker. The designated height of the seat support 130 is one that is configured for an infant's legs to contact the support surface. This allows the infant to move its legs in a walking motion while not having to fully support itself. When the infant uses its legs in the walking motion, the sliding or translating members 120 are moved along upper members 106, allowing the infant to walk from one end of the frame 100 to the other.

Further illustrated in FIG. 1 is a seat support 130, which consists of a platform 132 having a central opening 142 and a seat 144 coupled to the central opening 142. The seat 144 is configured to accept and support an infant. In this embodiment, the seat 144 is constructed from soft materials, such as fabrics and resilient foam, that create a seat 144 to cradle the infant placed within the seat 144. The seat 144 may further include two leg openings that enable the infant's feet to hang below the seat support 130. In the illustrated embodiment, the platform 132 has a substantially square or rectangular shape. Each of the resilient members 122 connects to the seat support 130 at each of the corners of the platform 132. Finally, the platform 132 may also include a variety of toys 146 surrounding the seat 144.

Figure 2:
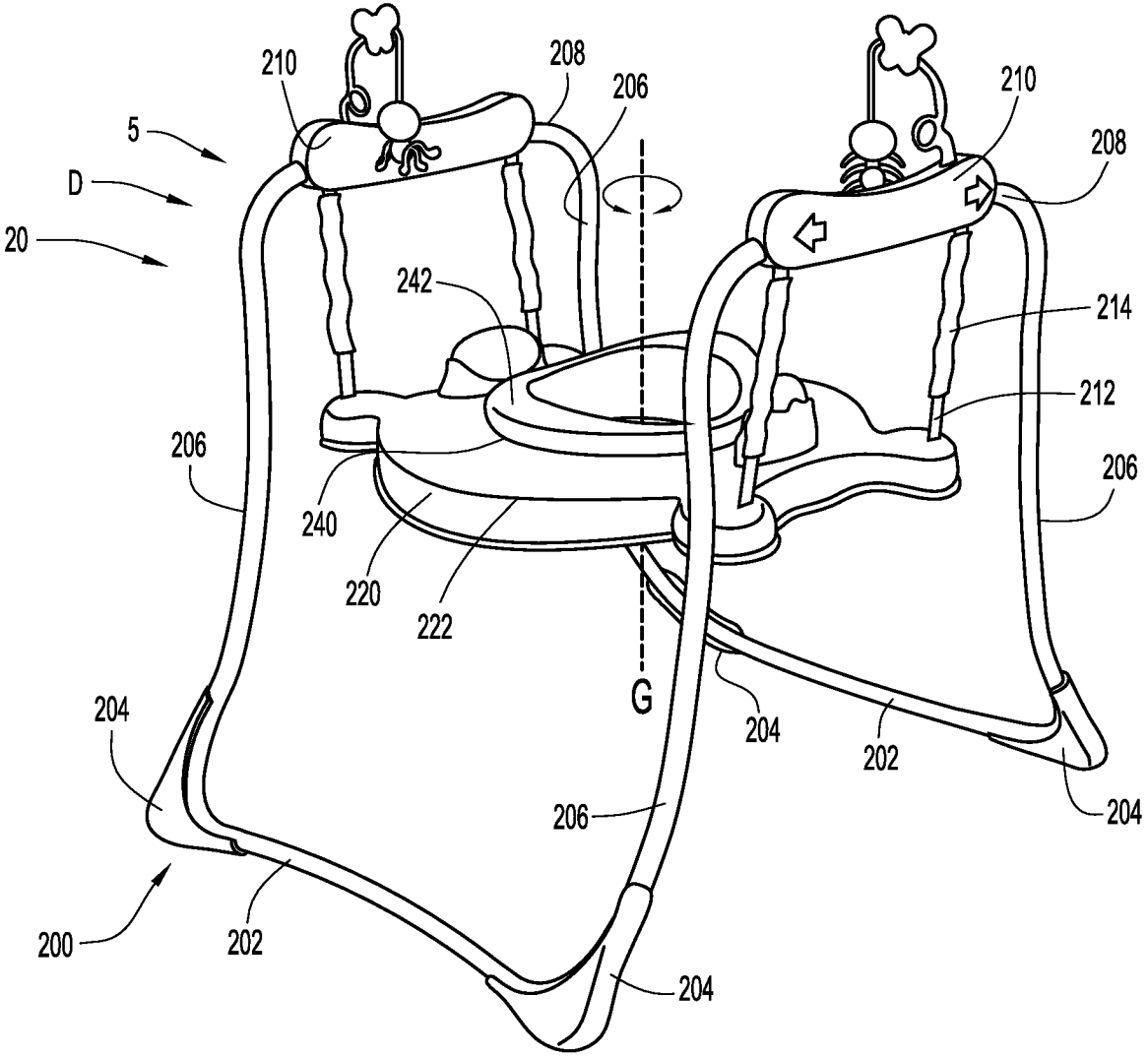
FIG. 2 illustrates a perspective view of a second embodiment of an infant support structure according to the present invention, the infant support structure being positioned in the compact configuration.
Figure 3:
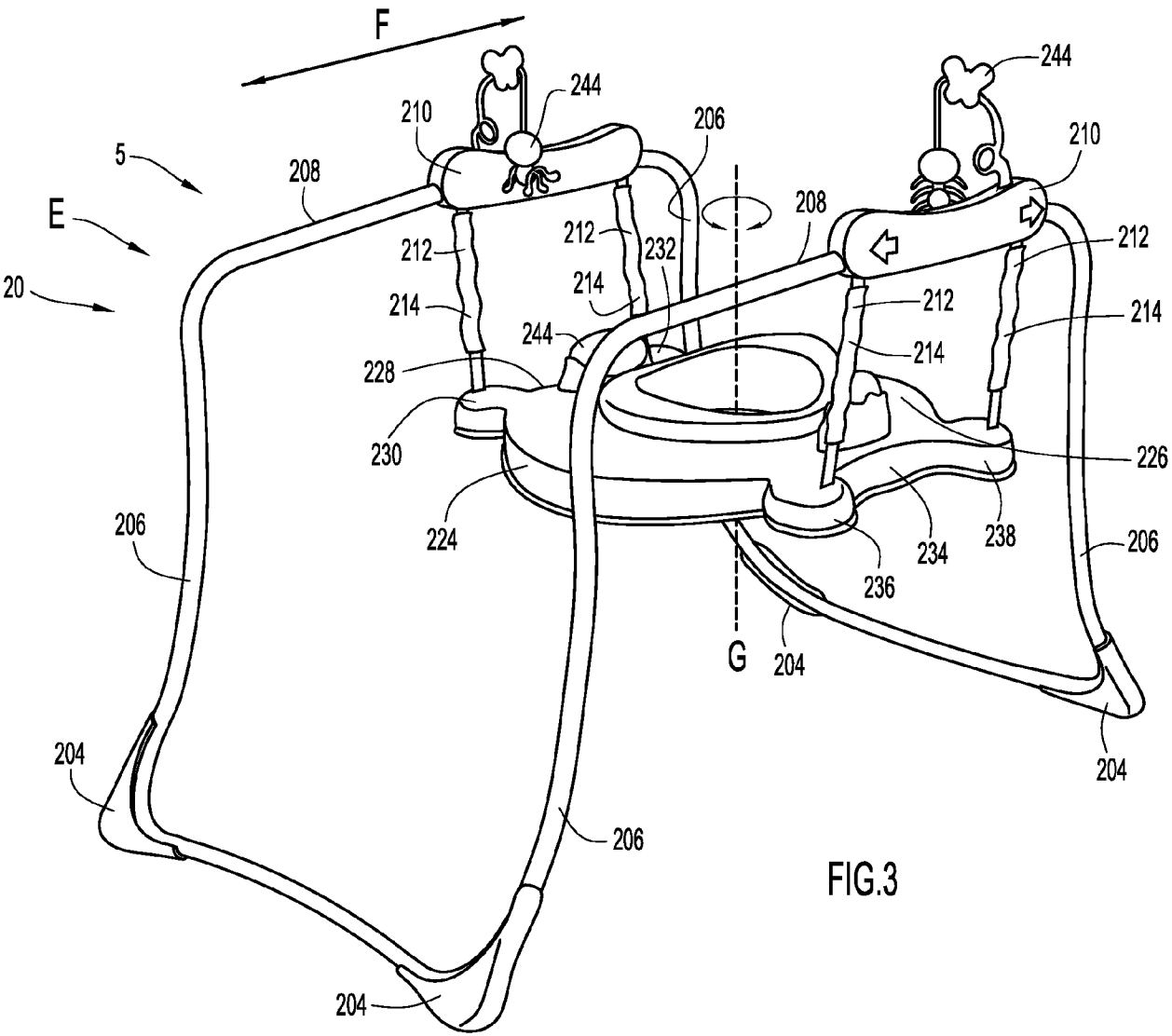
FIG. 3 illustrates a perspective view of the embodiment of the infant support structure illustrated in FIG. 2 with the infant support structure being positioned in the expanded configuration.

Turning to FIGS. 2 and 3, illustrated is a second embodiment 20 of the infant support structure 5. As illustrated, the second embodiment 20 includes a frame 200 that contains two lower parallel members 202, two parallel upper members 208, and four vertical members 206. In the second embodiment 20, the two lower parallel members 202 and the two parallel upper members 208 are oriented substantially perpendicular to one another. Furthermore, each one of the corners formed by the two lower parallel members 202 and the four vertical members 206 includes a foot 204. These feet 204 provide additional support and stability for the frame 200. The feet 204 may be constructed of, or contain, anti-skid material to prevent the infant support structure 5 from moving relative to the support surface. In addition, the upper parallel members 208 are configured to be telescopically expandable between a compact configuration D, which is illustrated in FIG. 2, and an expanded configuration E, which is illustrated in FIG. 3. In this second embodiment 20, the upper members 208 are expandable via a telescoping connection, however, other similar mechanisms may be used. The upper members 208 are configured to expand along direction F, which is illustrated in FIG. 3.

Similar to the first embodiment 10, the second embodiment 20 includes sliding or translating members 210 that are movably coupled to the upper members 208. The sliding or translating members 210 are wrapped around the upper members 208, and are configured to slide along direction F by internal ball bearings (or wheels) that rotate within the sliding or translating members 210 when the sliding or translating members 210 are moved along the upper members 208. In other embodiments, other similar mechanisms may be used to allow the sliding or translating members 210 to slide along the upper members 208. In these other embodiments, the sliding or translating members 210 and the upper members 208 may be constructed from materials that produce a low amount of rolling/sliding frictional resistance, reducing the number of moving parts, but still allowing the sliding or translating members 210 to slide along the upper members 208.

As further illustrated in FIGS. 2 and 3, each sliding or translating member 210 includes two resilient members 212. These resilient members 212 connect each of the sliding or translating members 212 to a seat support 220. The resilient members 212 are constructed from a spring, elastic band, or other similarly resilient material that will enable the seat support 220 to move up and down with respect to the frame 200 and sliding or translating members 210. Each of the resilient members 212 is attached to the sliding or translating members 210 at one of the ends of the sliding or translating members 210. Furthermore, the resilient members 212 each have a covering 214. The coverings 214 prevent the child from sticking their fingers, toys, and other items in the resilient members 212. The resilient members 212 support the seat support 220 above the support surface at a designated height. Because of their resiliency, the resilient members 212 allow for the seat support 220 to move, or bounce, up and down, side to side, and front to back.

Further illustrated in FIGS. 2 and 3 is a seat support 220, including a platform 222, a central opening 240 on the platform 222, and a rotatable seat 242 coupled to the central opening 240. The rotatable seat 242 is configured to rotate 360 degrees about axis G on the platform 222. Furthermore, the seat 242 is configured to accept and support an infant. While not illustrated in FIGS. 2 and 3, the seat 242 preferably includes soft materials, such as fabrics and resilient foam, that create a seat 242 to cradle the infant placed within the rotatable seat 242. The rotatable seat 242 may further include two leg openings that enable the infant's feet to hang below the seat support 220.

The platform 222 illustrated in FIGS. 2 and 3 has a substantially round shape, and includes a front 224, a rear 226, a first side 228, and a second side 234. Projecting horizontally from the first side 228 is a front first side protrusion 230 and a rear first side protrusion 232. Similarly, projecting from the second side 234 is a front second side protrusion 236 and a rear second side protrusion 238. Each of the resilient members 212 connects to the seat support 222 at each of the side protrusions 230, 232, 236, 238. The platform 222 may also include a variety of toys 244 surrounding the rotational seat 242. In addition, the sliding or translating members 210 may include toys 244 that move when the sliding or translating members 210 slide along the upper members 208 of the frame 200.

As previously described, the infant support structure 5 is configured to act as an infant walker and an infant jumper. In the second embodiment 20, the resilient members 212 are configured to resiliently support the seat support 220 above the support surface at a designated height. This height may be adjustable by adjusting the length of the resilient members 212 (or by telescopically adjusting the overall height of vertical members 206). This allows for the designated height of the seat support 220 to be set for each infant placed in the seat support 220. The resilient members 212 are configured to allow for upward and downward movement of the seat support 220 from the designated height set. Because the members 212 are resilient, the seat support 220 is configured to return the seat support 220 back to its original vertical position once the seat support 220 is moved upward and downward from its original vertical position. This allows for supported jumping motions by the infant sitting in the seat support 220.

Additionally, when the frame 200, and specifically the upper members 208, is in the expanded position E, the sliding or translating members 210 are configured to slide along the upper members 208. With the seat support 220 oriented at the height from the support surface for an infant's legs to come into contact with the support surface, the infant uses its legs in a walking motion to cause the sliding or translating members 210 to slide along the upper members 208. Because of the described orientation of the frame 200, sliding or translating members 210, and seat support 220, the infant can produce a walking motion while not having to fully support itself. The sliding or translating members 210 are moved along upper members 208, allowing the infant to walk from one end of the frame 200 to the other. Because of the rotatable seat 242, once the infant walks to one end of the frame 200, the infant can then rotate in place and walk to the other end of frame 200.

Figure 4:
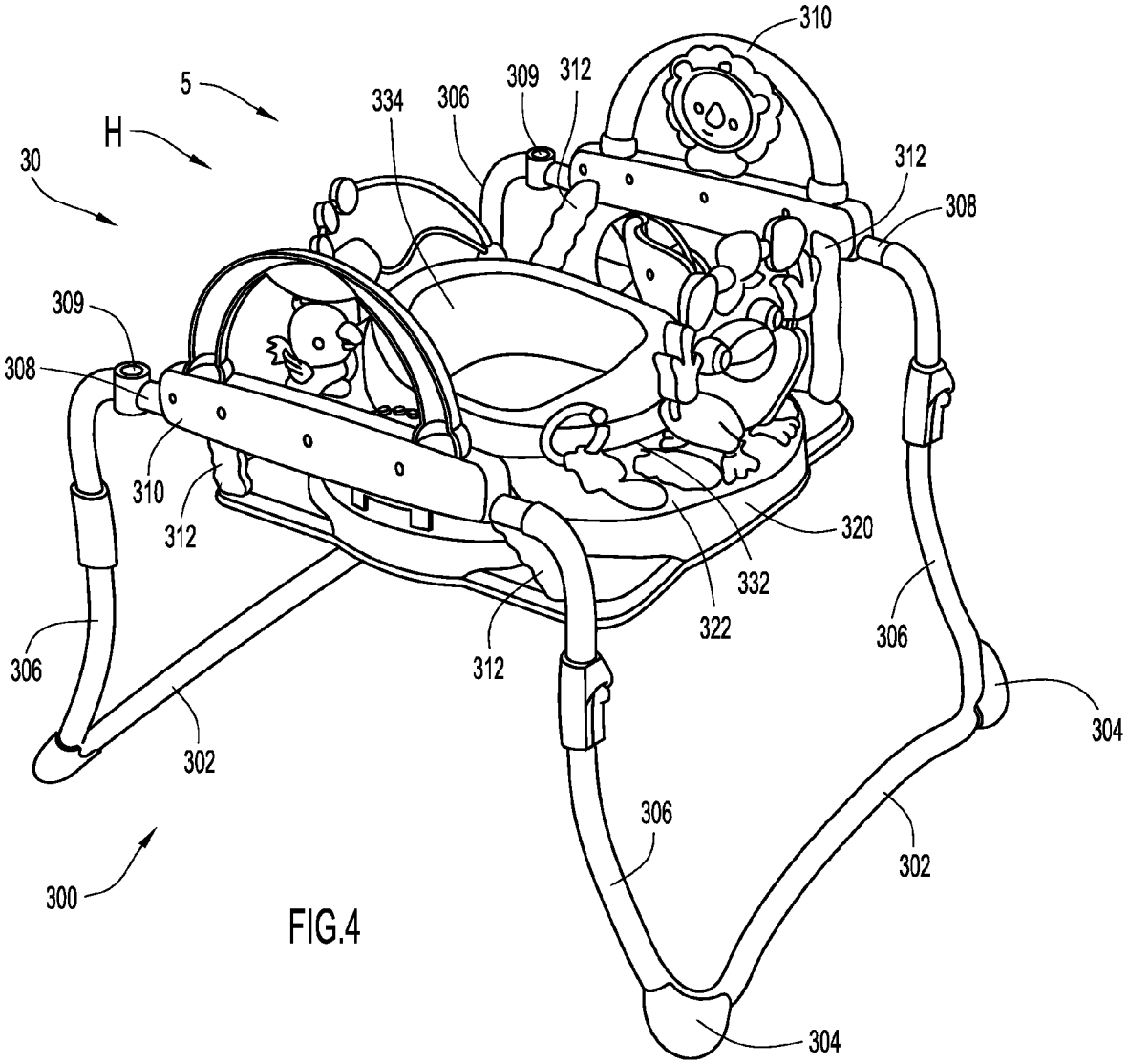
FIG. 4 illustrates a perspective view of a third embodiment of an infant support structure according to the present invention, the infant support structure being positioned in the compact configuration.
Figure 5:
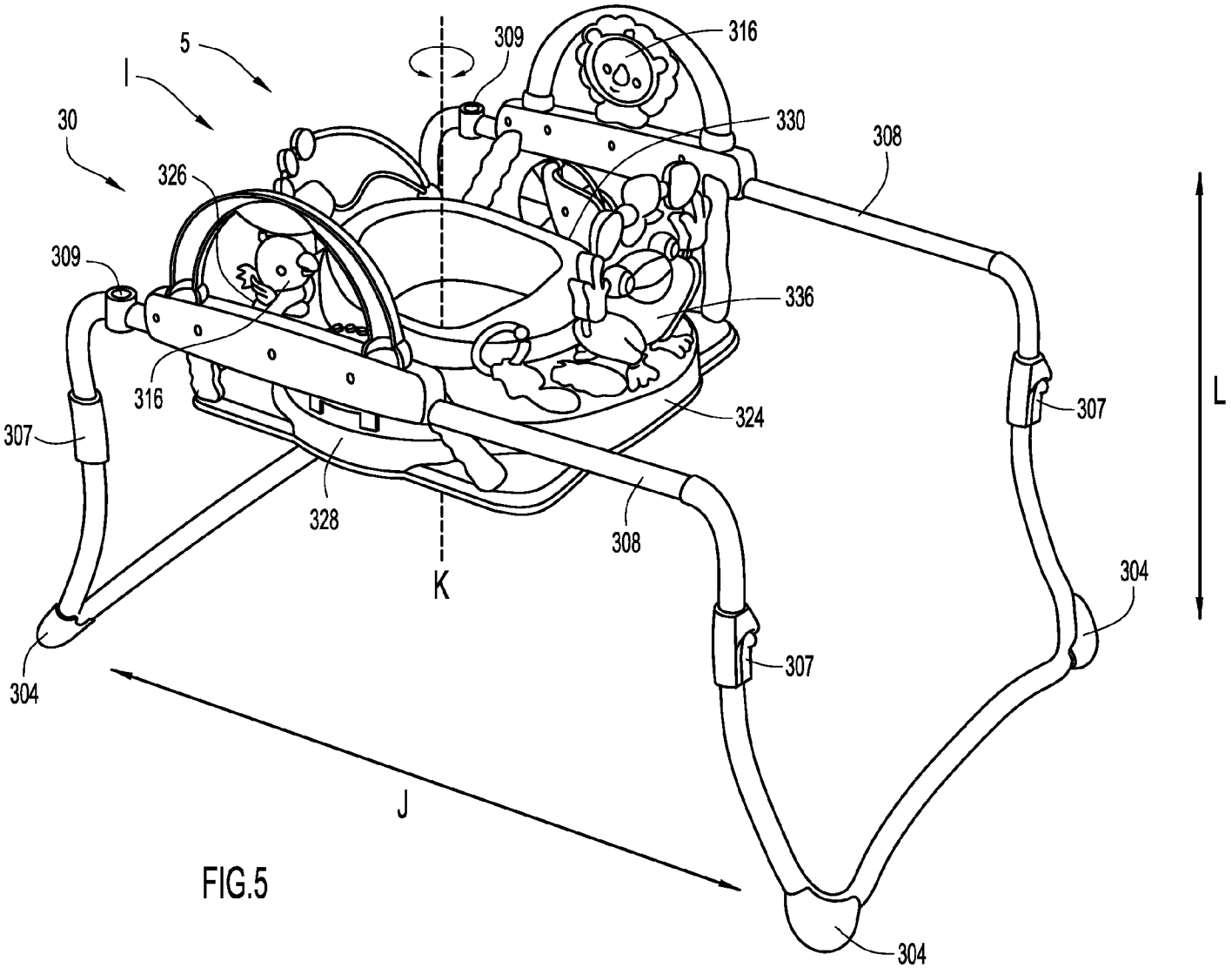
FIG. 5 illustrates a perspective view of the embodiment of the infant support structure illustrated in FIG. 4 with the infant support structure being positioned in the expanded configuration.

Turning now to FIGS. 4 and 5, illustrated is a third embodiment 30 of the infant support structure 5. Similar to the structure described for the frame 200 of the second embodiment 20, the third embodiment 30 includes a frame 300 with two lower parallel members 302, two parallel upper members 308, and four substantially vertical members 306. The two lower parallel members 302 and the two parallel upper members 308 are substantially perpendicular to one another. Additionally, the connection of each of the four substantially vertical members 306 to the ends of the two lower parallel members 302 creates a corner. Each of the corners includes a foot 304 that provides additional support and stability for the frame 300. The feet 304 may be constructed of, or contain, anti-skid material to prevent the infant support structure 5 from moving relative to the support surface.

Each one of the four substantially vertical members 306 includes a lever or mechanism 307 (see FIGS. 4 and 5). This mechanism 307 allows for the proper height adjustment of the frame 300, enabling the frame 307 to accommodate nearly every height of an infant that uses the infant support structure 5. The four substantially vertical members 306 are configured to expand and contract telescopically along direction L (see FIG. 5). In some embodiments the substantially vertical members 306 may include an upper support that is slidably or telescopically connected to a lower support. The mechanism 307 may frictionally retain the upper support and the lower support in various different vertical positions, allowing for different height adjustments. In other embodiments, the mechanism 307 may be a spring loaded lever that engages a series of apertures along the length of the lower or upper portion of the substantially vertical members 306. Depression of the spring loaded lever would disengage the lever from the apertures, allowing for height adjustment of the frame 300. The mechanism 307 may also be configured to allow assembly and disassembly of the infant support structure 5.

Additionally, the upper parallel members 308 are configured to be telescopingly expandable between a compact configuration H, which is illustrated in FIG. 4, and an expanded configuration I, which is illustrated in FIG. 5. The upper members 308 are expandable via a telescoping mechanism, however, other similar mechanisms may be used. The upper members 308 are configured to expand along direction J, which is illustrated in FIG. 5. The upper members 308 include actuators 309 that are used to lock and release the upper members 308 between the compact configuration H and the expanded configuration I. In another embodiment, the upper members 308 may not include actuators 309, and the upper members 308 are able to be freely reconfigurable between the compact configuration H and the expanded configuration I.

The third embodiment 30 includes sliding or translating members 310 that are movably coupled to the upper members 308. The sliding or translating members 310 are wrapped around the upper members 308, and are configured to slide along direction J on the upper members 308 via internal ball bearings or wheels that rotate within the sliding or translating members 310. In other embodiments, similar mechanisms may be utilized, including constructing the sliding or translating members 310 and the upper members 308 from materials that produce a low amount of rolling/sliding frictional resistance. This approach would reduce the number of moving parts of the sliding or translating members 310. In addition, the sliding or translating members 310 may include toys 316 that move, make noise, or light up when the sliding or translating members 310 slide along the upper members 308 of the frame 300.

As further illustrated in FIGS. 4 and 5, each sliding or translating member 310 includes two resilient members 312. The resilient members 312 are constructed from a spring, elastic band, or other similarly resilient material. Each of the resilient members 312 is attached to the sliding or translating members 310 at one of the ends of the sliding or translating members 310. These resilient members 312 connect each of the sliding or translating members 310 to a seat support 320. The resilient members 312 suspend the seat support 320 above the support surface at a designated height. Because of their resiliency, the resilient members 312 allow for the seat support 320 to move or bounce up and down, side to side, and front to back.

Further illustrated in FIGS. 4 and 5 is a seat support 320, including a platform 322, a central opening 332 on the platform 322, and a rotatable seat 334 coupled to the central opening 332. The rotatable seat 334 is configured to rotate 360 degrees about axis K on the platform 322. Furthermore, the seat 334 is configured to accept and support an infant. In some embodiments, the seat 334 may includes soft materials (illustrated in FIG. 6), such as fabrics and resilient foam, that create a seat 334 to cradle the infant placed within the rotatable seat 334. The rotatable seat 334 may further include two leg openings that enable the infant's feet to hang below the seat support 320.

The platform 322 illustrated in FIGS. 4 and 5 has a substantially square or rectangular shape, including a front 324, a rear 326, a first side 328, and a second side 330. Each one of the sides 324, 326, 328, 330 forms a corner. Each of the resilient members 312 connects to the seat support 320 at each of the corners. The platform 322 may also include a variety of toys 336 surrounding the rotational seat 334.

The third embodiment 30 of the infant support structure 5 is configured to act as an infant walker and an infant jumper. As previously explained, the resilient members 312 are configured to resiliently support the seat support 320 above the support surface at a designated height. This designated height is adjustable by adjusting the height of the frame 300 via the height adjustment mechanism 307 on the substantially vertical members 306. This allows for the designated height of the seat support 320 from the support surface to be set for each infant placed in the seat support 320. Because of the inclusion of the resilient members 312, the seat support 320 is configured to return the seat support 320 to its initial vertical position after the seat support 320 is moved upward and/or downward from its initial vertical position. This allows for supported jumping motions by the infant sitting in the seat support 320. In other words, the third configuration 30 can serve as an infant jumper.

Additionally, the third configuration 30 can serve as an infant walker when the upper members 308 are in the expanded position I, and the sliding or translating members 310 are able to slide along the upper members 308. The seat support 320 positions an infant into a supported standing position where the infant may use its legs in a walking motion to cause the sliding or translating members 310 to slide along the upper members 308. However, because of the adjusted height of the frame 300, the infant does not need to fully support itself on its own legs. The sliding or translating members 310 are moved along upper members 308, allowing the infant to walk from one end of the frame 300 to the other. Because of the rotatable seat 334, once the infant walks to one end of the frame 300, the infant can then rotate in place and walk to the other end of frame 300.

Figure 6:
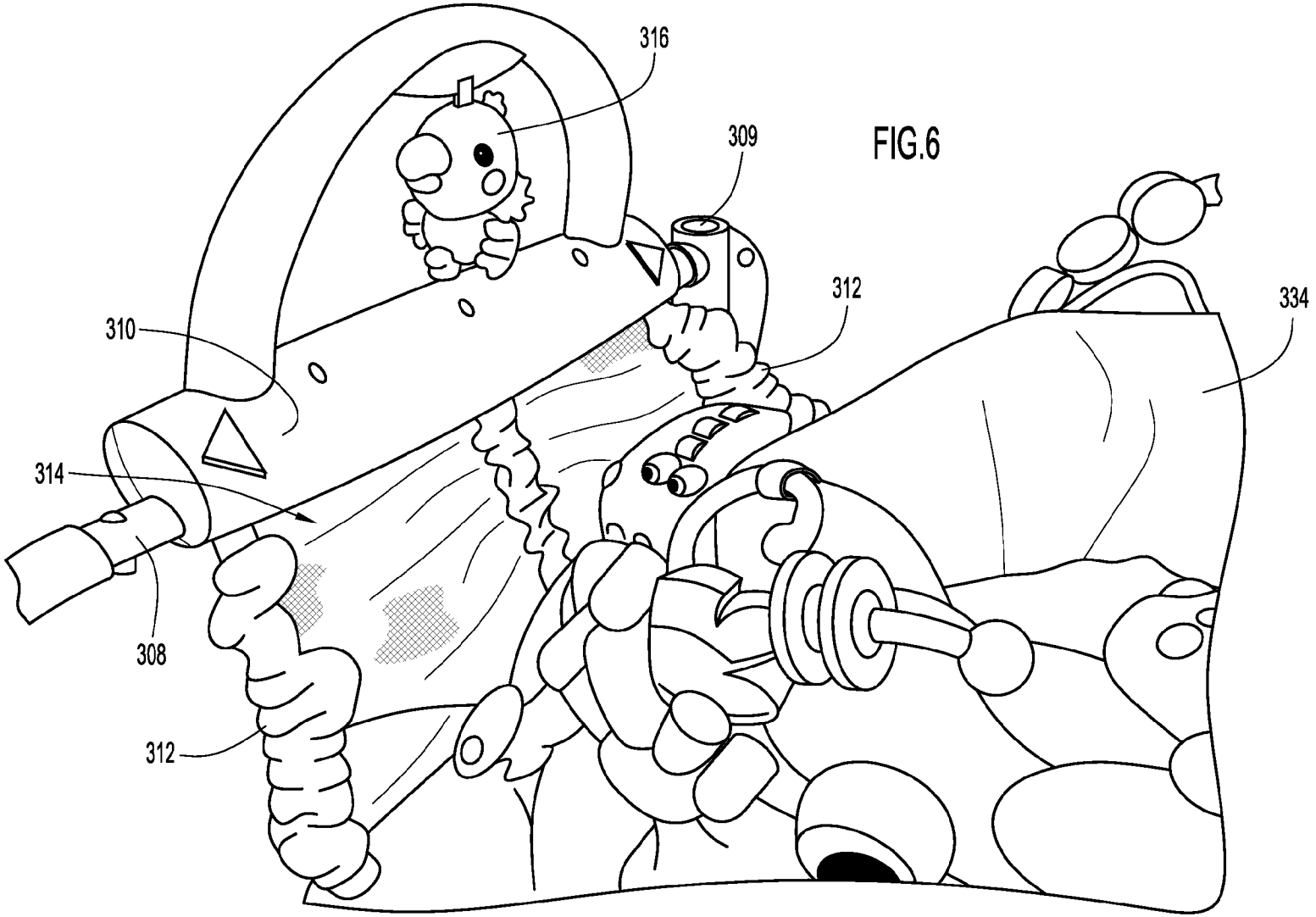
FIG. 6 illustrates a perspective view of the sliding or translating member of a modified version of the infant support structure illustrated in FIG. 4.

Referring now to FIG. 6, illustrated is a close-up perspective view of a sliding or translating member 310 and resilient members 312 of a modified version of the third embodiment 30 of the infant support structure 5. As illustrated, the resilient members 312 and the space therebetween have a mesh covering 314. Not only does the mesh 314 cover the individual resilient members 312, but the mesh covering 314 includes a mesh fabric that extends between the individual resilient members 312 on the sides 328, 330 (only the first side 328 is illustrated in FIG. 6) of the seat support 320. Furthermore, the mesh covering 314 contains interwoven resilient material that allows the mesh covering to expand and contract as the seat support 320 bounces and moves vertically and horizontally. The resilient mesh covering 314 prevents children from sticking body parts and items into the resilient members 312. Furthermore, the resilient mesh covering 314 prevents children from sticking body parts and items into the space between the sliding or translating members 310 and the seat support 320 as the sliding or translating members 310 and seat support 320 move relative to one another.

Figure 7:
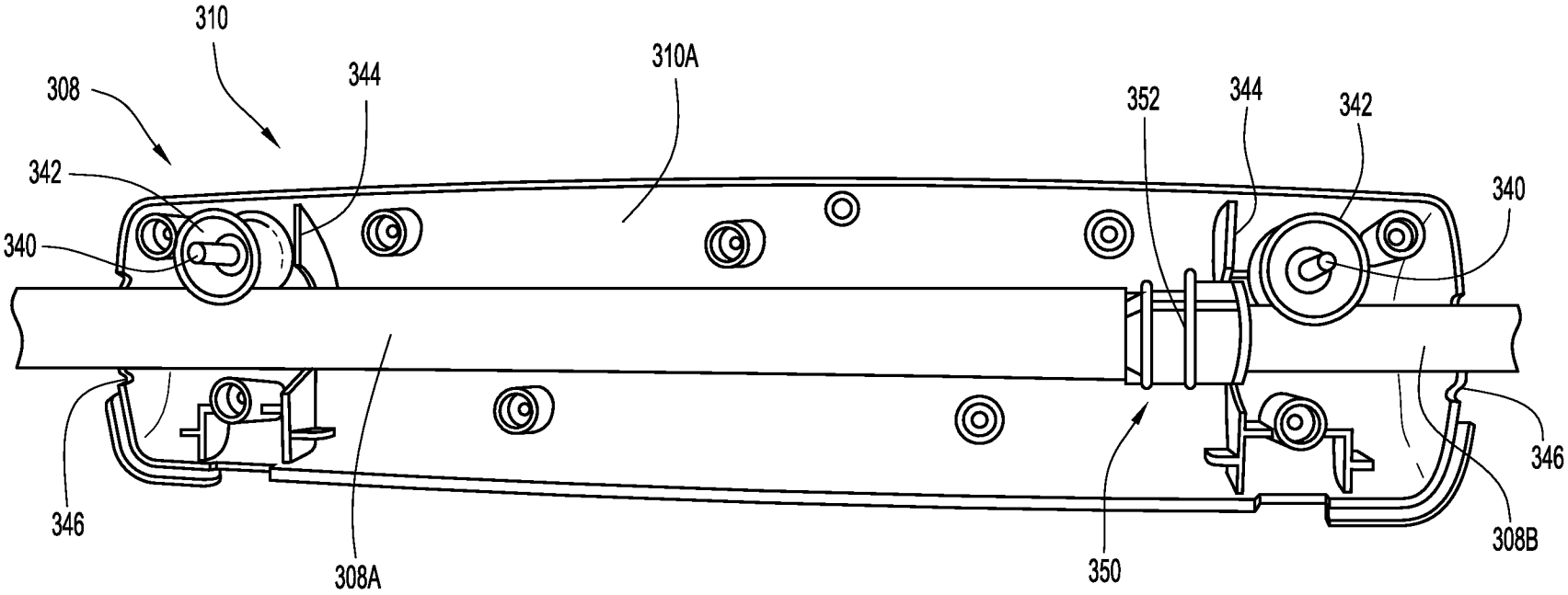
FIG. 7 illustrates an interior view of a first side of the sliding or translating member of the infant support structure illustrated in FIG. 4.
Figure 8:
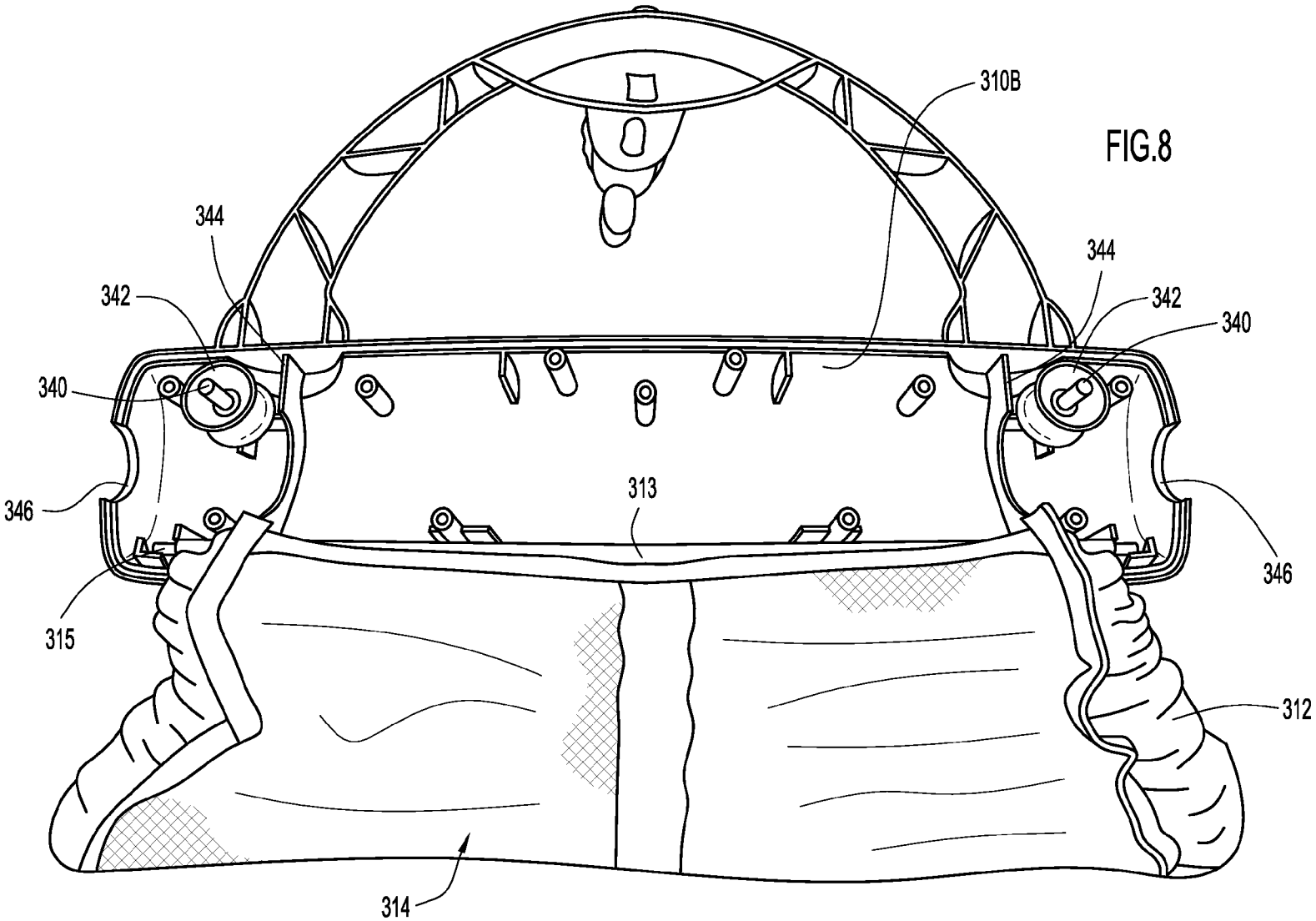
FIG. 8 illustrates an interior view of a second side of the sliding or translating member of the infant support structure illustrated in FIG. 4.

Turning to FIGS. 7 and 8, FIG. 7 illustrates the interior of the first side 310A of the sliding or translating member 310 with the first side 310A movably coupled to the upper member 308, while FIG. 8 illustrates the interior of the second side 310B of the sliding or translating member 310. While only the sliding or translating members 310 and the upper members 308 of one side of the third embodiment 30 of the infant support structure 5 are illustrated in FIGS. 7 and 8, the discussion of FIGS. 7 and 8 applies to both sliding or translating members 310 and both upper members 308 of the third embodiment 30 of the infant support structure 5. As illustrated in FIG. 7, the upper member 308 includes a first upper member 308A, a second upper member 308B, and a connector 350. As previously explained, the upper parallel members 308 are configured to be telescopingly expandable between a compact configuration H (illustrated in FIG. 4) and an expanded configuration I (illustrated in FIG. 5). As illustrated in FIG. 7, the connector 350 is inserted in one end of the first upper member 308A with one end of the second upper member 308B telescopingly inserted into the connector 350, and ultimately the first upper member 308A. Thus, the upper members 308 can be expanded from the compact configuration H (illustrated in FIG. 4) to and expanded configuration I (illustrated in FIG. 5) by sliding or translating the second upper member 308B out from the first upper member 308A and the connector 350.

Continuing with FIGS. 7 and 8, the interior of the first side 310A and second side 310B of the sliding or translating member 310 each include a half of an opening 346 on each end of the sliding or translating member 310. Furthermore, proximate to each end of the sliding or translating member 310, the interior of the first side 310A and the second side 310B include flanges 344. As illustrated in FIGS. 4-6, the first side 310A and the second side 310B, when formed together, movably enclose the upper member 308 with the half openings 346 and the flanges 344 of the first side 310A aligning with the half openings 346 and flanges 344 of the second side 310B. The half openings 346 of the sides 310A, 310B together form an opening sized to encircle the upper member 310. The flanges 344 of the sides 310A, 310B also encircle the upper member 308. In addition, the interiors of the first side 310A and the second side 310B house a total of two axles 340, one located between the flanges 344 and the half openings 346 on each end of the sliding or translating member 310. Each axle 340 is configured to rotatably receive a single wheel 342. As illustrated in FIGS. 7 and 8, the wheels 342 may be hourglass shaped and configured to engage the top of the upper member 308. Note that the two wheels 342 and two axles 340 are shown in each of FIG. 7 and FIG. 8 for illustrative purposes only (there are only two wheels 342 and two axles 340 that are sandwiched between the first side 310A and the second side 310B). The wheels 342 rotate about the axles 340, and over the top of the upper member 308, to allow the sliding or translating member 310 to travel back and forth across the upper member 308 when the upper member is in the expanded configuration I (illustrated in FIG. 5).

Moreover, as illustrated in FIG. 7, the connector 350 of the upper member 308 includes a tab 352 that extends outward around the circumference the connector 350. The tab 352 is sized and configured to extend a distance from the connector 350 to engage the flanges 344 on each end of the sliding or translating member 310. Thus, when the upper member 308 is in the expanded configuration I (illustrated in FIG. 5), the tab 352 of the connector 350, by contacting the flanges 344 on each side of the sliding or translating member 310, prevents the sliding or translating member 310 from traveling too far in either direction on the upper member 308. Furthermore, as illustrated by FIG. 7, the connector 350 always remains within the sliding or translating member 310.

Turning to FIG. 8, further illustrated is the connection of the resilient members 312 and the mesh covering 314 to the sliding or translating member 310. As previously stated, the mesh covering 314 covers the individual resilient members 312. Furthermore, the end of the mesh covering 314 includes a sleeve 313. As illustrated, the sleeve 313 is configured to receive a bar or rod 315. The rod 315 is preferably constructed from a metallic material or other rigid and durable material. FIG. 8 illustrates that the rod 315 extends nearly the entire length of the second side 310B of the sliding or translating member 310. When the first side 310A and the second side 310B of the sliding or translating member 310 are connected to each other, the rod 315, the sleeve 313, and a small portion of the mesh covering 314 are trapped therebetween. Thus, rod 315, sleeve 313, and a portion of the mesh covering 314 are positioned within the sliding or translating member 310. The connection of the first side 310A to the second side 310B secures the mesh covering 314, and ultimately the resilient members 312, to the sliding or translating member 310. In other embodiments, the mesh covering 314 may be attached to the sliding or translating member 310, such as being sewn to a plastic flange disposed within the sliding or translating member 310.

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. An infant support structure comprising:

a frame including at least two substantially parallel members, where the parallel members are reconfigurable between a compact configuration and an extended configuration;

at least one translating member movably disposed on at least one of the substantially parallel members;

a seat support; and at least one resilient member coupling the at least one translating member and the seat support for both bouncing and translating movement of the seat support.

2. The infant support of claim 1, wherein the two substantially parallel members are substantially horizontal.

3. The infant support of claim 2, wherein the frame further comprises:

four substantially vertical supports that support the two parallel members above a supporting surface.

4. The infant support of claim 1, wherein the seat support includes a seat configured for receiving an infant.

5. The infant support of claim 1, wherein the at least one translating member includes internal wheels for rolling along at least one of the two parallel members.

6. An infant support structure comprising:

a frame comprising:

at least two substantially parallel upper members, and at least two substantially parallel lower members being substantially parallel to the parallel upper members, wherein the two parallel upper members and the two parallel lower members are reconfigurable between a compact configuration and an extended configuration;

at least one translating member movably disposed on at least one of the substantially parallel upper members;

a seat support; and at least one resilient member coupling the at least one translating member and the seat support for both bouncing and translating movement of the seat support.

7. The infant support of claim 6, wherein the parallel upper members and the parallel lower members are substantially horizontal.

8. The infant support of claim 7, wherein the frame further comprises:

four substantially vertical supports that couple the parallel upper members to the parallel lower members.

9. The infant support of claim 6, wherein the seat support includes a seat configured for receiving an infant.

10. The infant support of claim 6, wherein the at least one translating member includes internal wheels for rolling along at least one of the two parallel upper members.

11. The infant support of claim 6, further comprising a covering that encompasses at least a portion of the at least one resilient member.

12. An infant support structure comprising:

a frame comprising:

at least two substantially parallel upper members reconfigurable between a compact configuration and an extended configuration, and at least two substantially parallel lower members being substantially perpendicular to the upper parallel members and configured to engage a supporting surface;

at least one translating member movably disposed on at least one of the substantially parallel upper members;

a seat support; and at least one resilient member coupling the at least one translating member and at least one seat support for both bouncing and translating movement of the seat support.

13. The infant support of claim 12, wherein the parallel upper members and the parallel lower members are substantially horizontal.

14. The infant support of claim 13, wherein the frame further comprises:

four substantially vertical supports that couple the parallel upper members to the parallel lower members.

15. The infant support of claim 14, wherein the four substantially vertical supports are reconfigurable between a lowered configuration and a raised configuration.

16. The infant support of claim 12, wherein the seat support includes a rotatable seat configured for receiving an infant.

17. The infant support of claim 12, wherein the at least one translating member includes internal wheels for rolling along at least one of the two parallel upper members.

18. The infant support of claim 12, wherein the at least one resilient member includes a first resilient member and a second resilient member.

19. The infant support of claim 18, further comprising a panel covering that encompasses the first resilient member and the second resilient member, the panel covering extending between the first resilient member and the second resilient member.

20. The infant support of claim 12, wherein the at least one translating member movably disposed on at least one of the substantially parallel upper members is two translating members, one each of the two translating members movably disposed on each one of the substantially parallel upper members.

* * * * *